United States Patent [19]

Winckler

[11] Patent Number: 4,831,673

[45] Date of Patent: May 23, 1989

[54] APPARATUS FOR HOLDING ARTICLES TO A BED

[76] Inventor: John Winckler, North Hills, N.Y.

[21] Appl. No.: 174,147

[22] Filed: Mar. 28, 1988

[51] Int. Cl.[4] ..... A47C 21/00; A47G 29/00

[52] U.S. Cl. ..... 5/503; 248/214; 248/311.2

[58] Field of Search ..... 5/503, 507, 508; 248/214, 311.2, 314

[56] References Cited

U.S. PATENT DOCUMENTS

| | | | |
|---|---|---|---|
| 1,686,002 | 10/1928 | Herron | 5/503 |
| 2,665,869 | 1/1954 | Samuels | 248/214 |
| 3,325,038 | 6/1967 | Ferney | 248/214 |
| 4,431,154 | 2/1984 | Hamm | 5/503 |
| 4,504,992 | 3/1985 | Herron et al. | 5/507 |
| 4,560,128 | 12/1985 | Willeby et al. | 248/311.2 |
| 4,606,523 | 8/1986 | Statz et al. | 248/311.2 |
| 4,672,703 | 6/1987 | Frazier | 5/503 |

FOREIGN PATENT DOCUMENTS

| | | | |
|---|---|---|---|
| 1456691 | 11/1976 | United Kingdom | 248/214 |

*Primary Examiner*—Alexander Grosz

*Attorney, Agent, or Firm*—Michael I. Kroll

[57] ABSTRACT

An apparatus for holding articles to a bed having a mattress, box spring and bed frame is provided and consists of a receptacle member formed to back of a channel shaped clamp member that can be attached to side of the bed frame. The receptacle member has an open top to hold the articles therein so that a person can remove the articles from the receptacle member when needed.

3 Claims, 1 Drawing Sheet

APPARATUS FOR HOLDING ARTICLES TO A BED

BACKGROUND OF THE INVENTION

1. Field of the Invention

The instant invention realtes generally to containers and more specifically it relates to an apparatus for holding articles to a bed.

2. Description of the Prior Art

Numerous containers have been provided in prior art that are adapted to hold various items therein to be used by people when needed. For example, U.S. Pat. Nos. 4,466,146; 4,472,843 and 4,659,099 all are illustrative of such prior art. While these units may be suitable for the particular purpose to which they address, they would not be as suitable for the purposes of the present invention as heretofore described.

SUMMARY OF THE INVENTION

A primary object of the present invention is to provide an apparatus for holding articles to a bed that will overcome the shortcomings of the prior art devices.

Another object is to provide an apparatus for holding articles to a bed that can be attached to side of a bed frame so that a person can remove the articles when needed.

An additional object is to provide an apparatus for holding articles to a bed that is fabricated out of a unitary piece of durable material which can be attached to the bed frame without using special tools or instructions.

A further object is to provide an apparatus for holding articles to a bed that is simple and easy to use.

A still further object is to provide an apparatus for holding articles to a bed that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
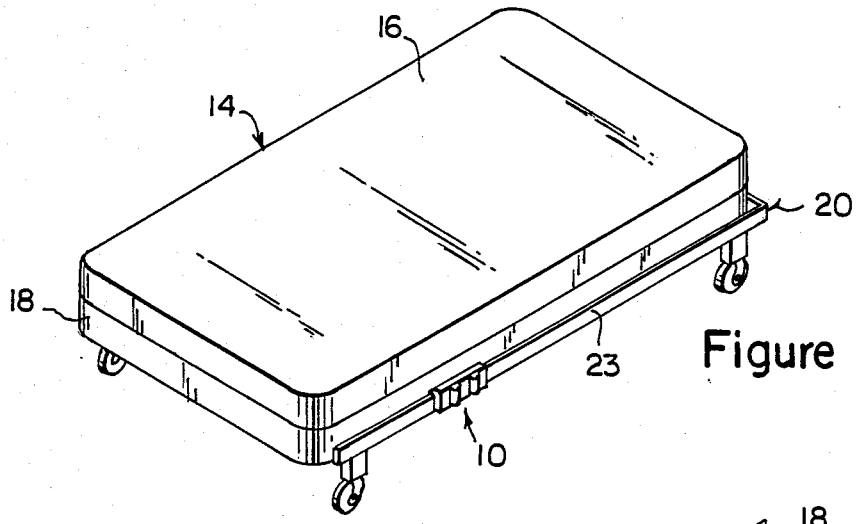
FIG. 1 is a perspective view of a bed with the invention attached to the bed frame.
Figure 2:
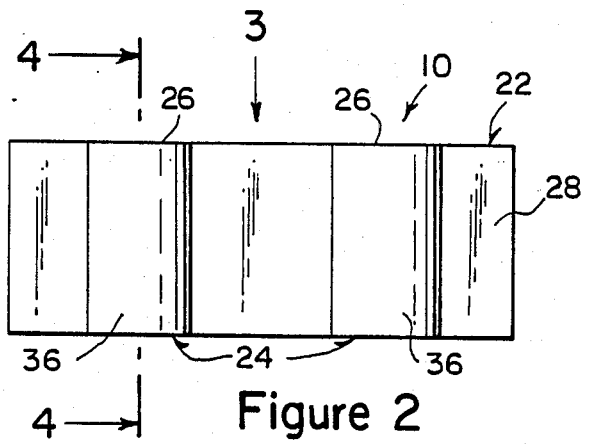
FIG. 2 is a front elevational view of the invention.
Figure 4:
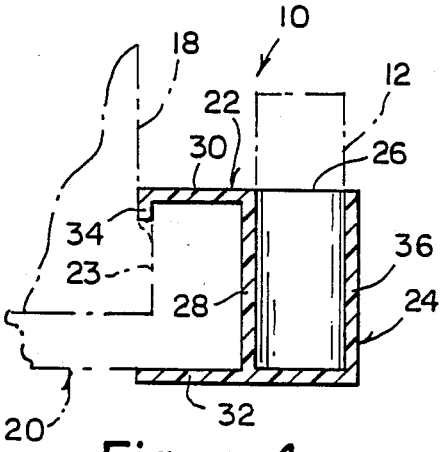
FIG. 4 is a cross sectional view taken along line 4—4 in FIG. 2.
Figure 3:
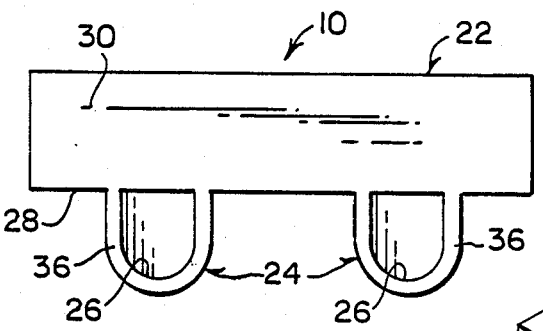
FIG 3 is a top view taken in direction of arrow in FIG. 2.

Turning now descriptively to the drawings, in which similar reference characters denote similar elements throughout the several views the figures illustrate an apparatus 10 for holding articles 12, such as drinks, food and other items, to a bed 14 that has a mattress 16, a box spring 18 and a bed frame 20.

The apparatus 10 consists of a channel shaped clamp member 22 that can be attached to side 23 of the bed frame 20. A receptacle member 24 is formed to back of the clamp member 22. The receptacle member 24 has an open top 26 to hold the articles 12 therein, so that a person (not shown) can remove the articles 12 from the receptacle member 24 when needed.

The clamp member 22 includes a web 28 of a predetermined length and a pair of flanges 30 and 32. Each of the flanges are formed onto an opposite end of the web 28 so that the upper flange 30 can fit over the side 23 of the bed frame 20 while the lower flange 32 can fit under the side 23 of the bed frame 20. A downwardly extending lip 34 is formed onto distal end of the upper flange 30 so that the lip 34 will prevent the upper flange 30 from slipping off the side 23 of the bed frame 20.

Figure 5:
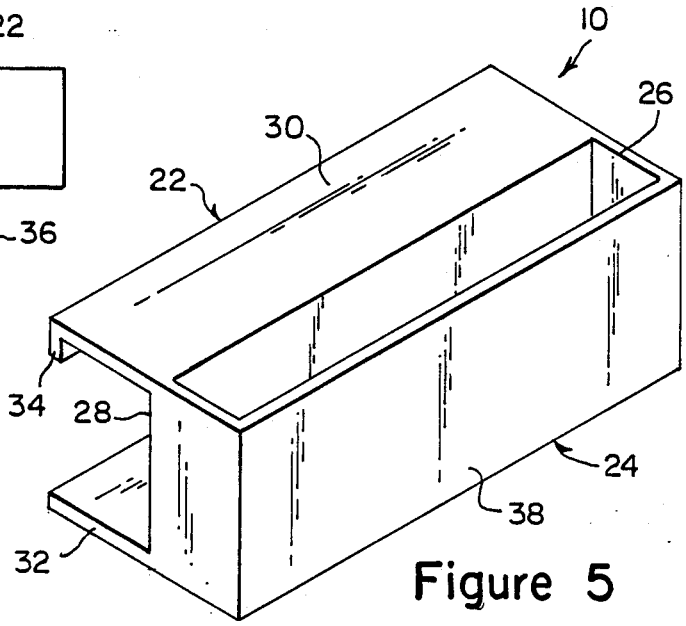
FIG. 5 is a perspective view of a modification in which a box-like receptacle is utilized to hold various articles therein.

The receptacle member 24, as shown in FIGS. 1 through 4, is two cylindrical shaped housings 36 to hold the articles 12 therein while the receptacle member 24 shown in FIG. 5 is a box-like shaped housing 38 to hold the articles 12 therein.

The apparatus 10 can be fabricated out of a unitary piece of durable material, such as plastic, metal, etc., which can be attached to the bed frame 20 without using special tools or instructions.

It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for holding articles to a conventional bed of the type having a conventional mattress, a conventional box spring and a conventional bed frame that has an L-shaped cross section, said apparatus comprising:

(a) a channel shaped clamp member that can be positively secured to a side of the conventional bed frame, the conventional bed frame being substantially rigid and disposed below the conventional box spring and supporting the conventional box spring, said clamp member including a vertical web being of a predetermined length, a lower horizontal flange and a parallel, horizontal upper flange, each of said flanges formed into an opposite end of said web so that said upper flange can fit over and contact the horizontal, top portion of the side of the conventional bed frame while said lower flange can fit under and contact the lower, horizontal bottom portion of the side of the conventional bed frame, and a downwardly extending lip formed onto distal end of said upper flange so that said lip will prevent said upper flange from slipping off the side of said conventional bed frame; and (b) a receptacle member formed to the back of said clamp member and forming an integral unit therewith, said receptacle member having an open top to hold the articles therein, so that a person can remove the articles from said receptacle member when needed.

2. An apparatus as recited in claim 1, wherein said receptacle member is at least one cylindrical shaped housing to hold the articles therein.

3. An apparatus as recited in claim 1, wherein said receptacle member is a box-like shaped housing to hold the articles therein.

* * * * *